US007731018B2

(12) United States Patent
Mims

(10) Patent No.: US 7,731,018 B2
(45) Date of Patent: Jun. 8, 2010

(54) ROTARY GATHERER WITH COLLAPSIBLE PINS

(75) Inventor: John Douglas Mims, Bow, NH (US)

(73) Assignee: Goss International Americas, Inc, Durham, NH (US)

( * ) Notice: Subject to any disclaimer, the term of this patent is extended or adjusted under 35 U.S.C. 154(b) by 701 days.

(21) Appl. No.: 11/074,421

(22) Filed: Mar. 8, 2005

(65) Prior Publication Data

US 2006/0202413 A1 Sep. 14, 2006

(51) Int. Cl.
*B65G 19/24* (2006.01)
*B65H 5/16* (2006.01)

(52) U.S. Cl. ..... 198/732; 198/731; 198/728; 271/271

(58) Field of Classification Search ..... 271/10.1, 271/275, 207, 314, 21, 271; 198/732, 731, 198/128

See application file for complete search history.

(56) References Cited

U.S. PATENT DOCUMENTS 3,578,310 A * 5/1971 Carson, Jr. ..... 270/52.04
3,825,247 A 7/1974 Fernandez-Rana et al. .... 270/58
5,375,827 A * 12/1994 Lentz et al. ..... 271/270
5,711,412 A * 1/1998 Gysin et al. ..... 198/732
5,937,999 A * 8/1999 Spatafora ..... 198/728
5,964,461 A * 10/1999 Ende et al. ..... 271/271
6,237,746 B1 * 5/2001 Sussmeier ..... 198/732
6,378,693 B1 * 4/2002 Ballestrazzi et al. ..... 198/732
6,623,000 B2 * 9/2003 Hall ..... 271/11
6,726,201 B2 * 4/2004 Studer ..... 271/204
7,017,733 B2 * 3/2006 Pfankuch ..... 198/731

* cited by examiner

*Primary Examiner*—Patrick Mackey
*Assistant Examiner*—Luis Gonzalez
(74) *Attorney, Agent, or Firm*—Davidson, Davidson & Kappel, LLC

(57) ABSTRACT

A rotary gatherer has drums for delivering printed sheet materials and a conveyor having a conveyor chain and a first pin and a second pin connected to the chain and defining a pocket for receiving the printed sheet materials from the drums. The first pin may include a first section movable horizontally and vertically along a predetermined path with respect to the conveyor chain when subjected to a vertical force. A conveyor, a pin and a related method also are disclosed.

12 Claims, 5 Drawing Sheets

ROTARY GATHERER WITH COLLAPSIBLE PINS

BACKGROUND OF THE INVENTION

The present invention relates generally to devices with printed sheet material conveyors, for example rotary gatherers, and to conveyors used to carry printed sheet materials, and to pins used to push printed sheet materials.

U.S. Pat. No. 3,825,247 describes a rotary gatherer having a plurality of gripper drums delivering printed sheet materials such as signatures to a conveyor. Pins which extend perpendicularly from the conveyor chain define pockets for the gathered signatures in a conveying direction. U.S. Pat. No. 3,825,247 is hereby incorporated by reference herein.

In addition to rigid pins extending from the conveyor chain, FIG. 1 shows a prior art device in which the pin 4 is mounted on a single pivot 6 attached to a base fixed to the chain 8.

A pin that consists of a round plastic rod or tub and fixed via a base to the chain is also known.

Drop down guards may be required to limit access to the raceway defined by the conveyor chain. Raising and lowering the guards can significantly increase downtime of a rotary gatherer. A main reason for the drop down guards is to protect against hazards created as the pins pass underneath the drums.

BRIEF SUMMARY OF THE INVENTION

Rigid pins extending from the chain can cause hazards as the pins pass or contact the rotating drum surface, since materials or objects, such as operator clothing, could be pinched between the pin and the rotating drum surface. The prior art pins with a pivot or plastic tube can bend due to a horizontal force, but do not fold back if subjected to a vertical force in line with the pivot. For example, the rotating drum surface contacting the top of the pin or an object stuck between the top of the pin and the rotating drum surface can cause such a vertical force.

An object of the present invention is to reduce hazards caused by prior art pins. Another alternate or additional object of the present invention is permit a vertical force acting on the pin to easily collapse the pin.

The present invention provides a rotary gatherer comprising:

a plurality of drums for delivering printed sheet materials; and a conveyor having a conveyor chain and a first pin and a second pin connected to the chain and defining a pocket for receiving the printed sheet materials from the drums, the first pin including a first section movable horizontally and vertically along a predetermined path with respect to the conveyor chain when subjected to a vertical force.

By permitting a controlled, predetermined movement of the first pin when the first pin is subjected to a vertical force, the collapsibility of the pin can be improved and safety of the rotary gatherer improved.

The first pin may include a second section fixed to the chain, the first section being connected to the second section or the chain via a first arm, the first section having an operating position and a retracted position. The first arm may be at an angle other than 90 degrees to a traveling receiving surface of the conveyor chain when the first section is in the operating position. The operating position angle may be for example between 60 and 70 degrees, for example 65 degrees.

The first pin may include further arms, for example three further arms, for supporting the upper section, and all of the arms may have a similar operating position angle.

The first section or second section may include a cutaway interacting with a raised section on the other section to limit sideways motion of the first section.

The first section preferably is spring-loaded in the direction of the operating position, and preferably the first section exerts less than 11 lbs (49 N) on an object coming into contact with the first section while the first section is between the operating and retracted position. The spring may be for example a torsion spring so that the force is greatest at the retracted position, but less at the operating position. The torsion spring may be located about a pivot supporting one of the arms, for example a pivot passing through the first section.

Preferably, the first pin includes a stop preventing the first section from moving past the operating position in a direction opposite the retracted position. The stop for example may be a stop plate fixed to one arm and interacting with a pivot supporting another arm. The spring may be preloaded so that some force is present at the operating position to force the first section against the stop.

Each pin, including the second pin, may be of similar construction to the first pin.

The rotary gatherer of the present invention may be free of drop down guards at the sides of the drums which drop down to guard the space between the chain and the drums.

The present invention also provides a conveying device for printed sheet materials including a pin similar to the first pin, and the present invention also includes a pin as described with respect to the first pin.

"Chain" as defined herein can be any type of device suitable for gathering sheets of printed materials, and may for example include a belt.

The present invention also provides a method for operating a rotary gatherer including the steps of:

moving a conveyor in first direction, the conveyor having a plurality of pins defining printed sheet material pockets therebetween;

gathering printed sheet material in the pockets; and permitting at least a section of the pins to move along a predefined path when subjected to vertical force.

Figure 1:
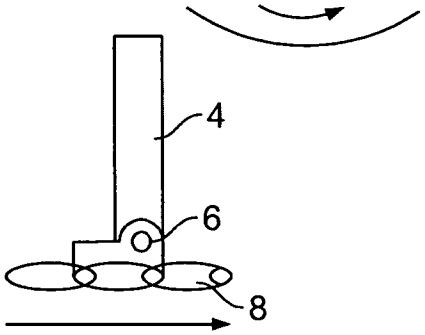
FIG. 1 (Prior Art)
FIG. 1 shows a prior art embodiment of a pin of a rotary gatherer.
Figure 2:
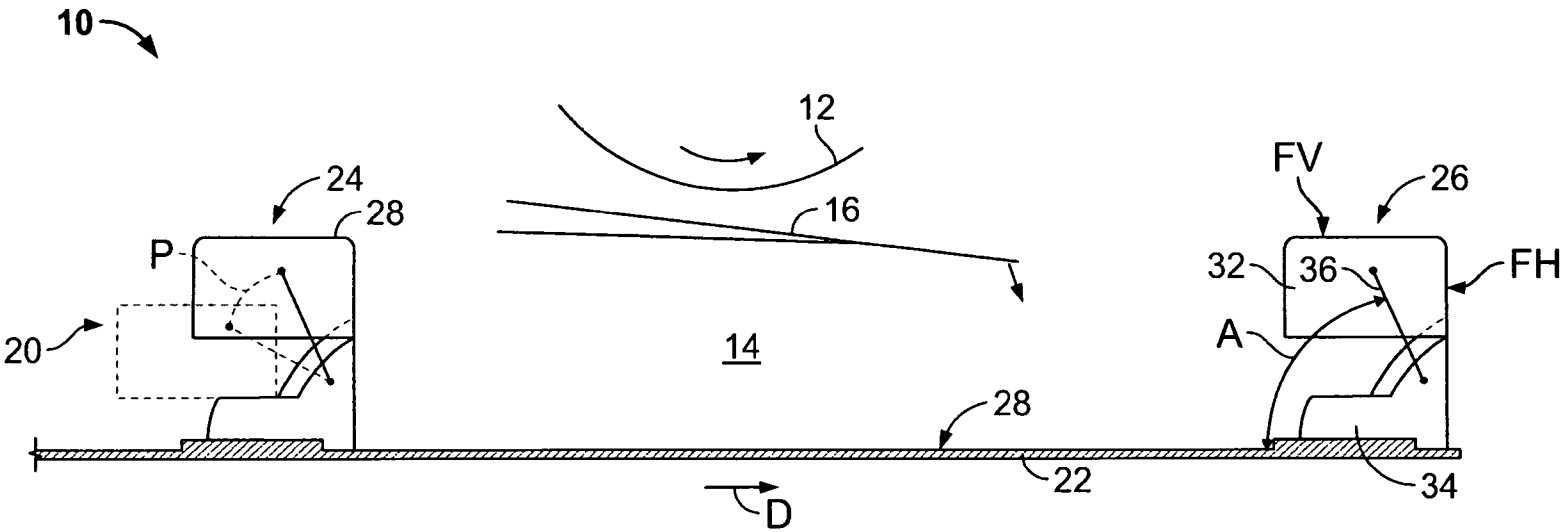
Figure 3:
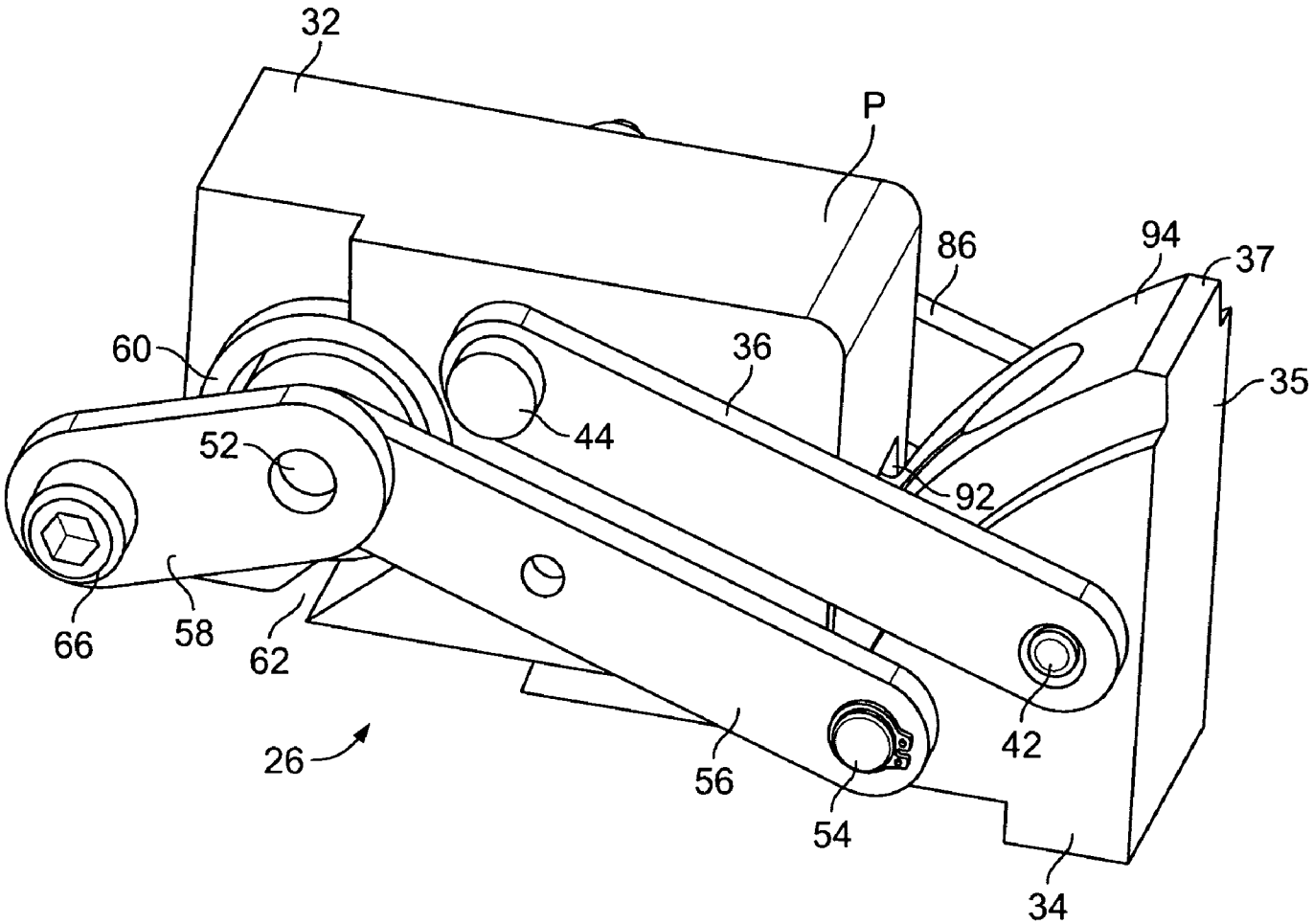
Figure 4:
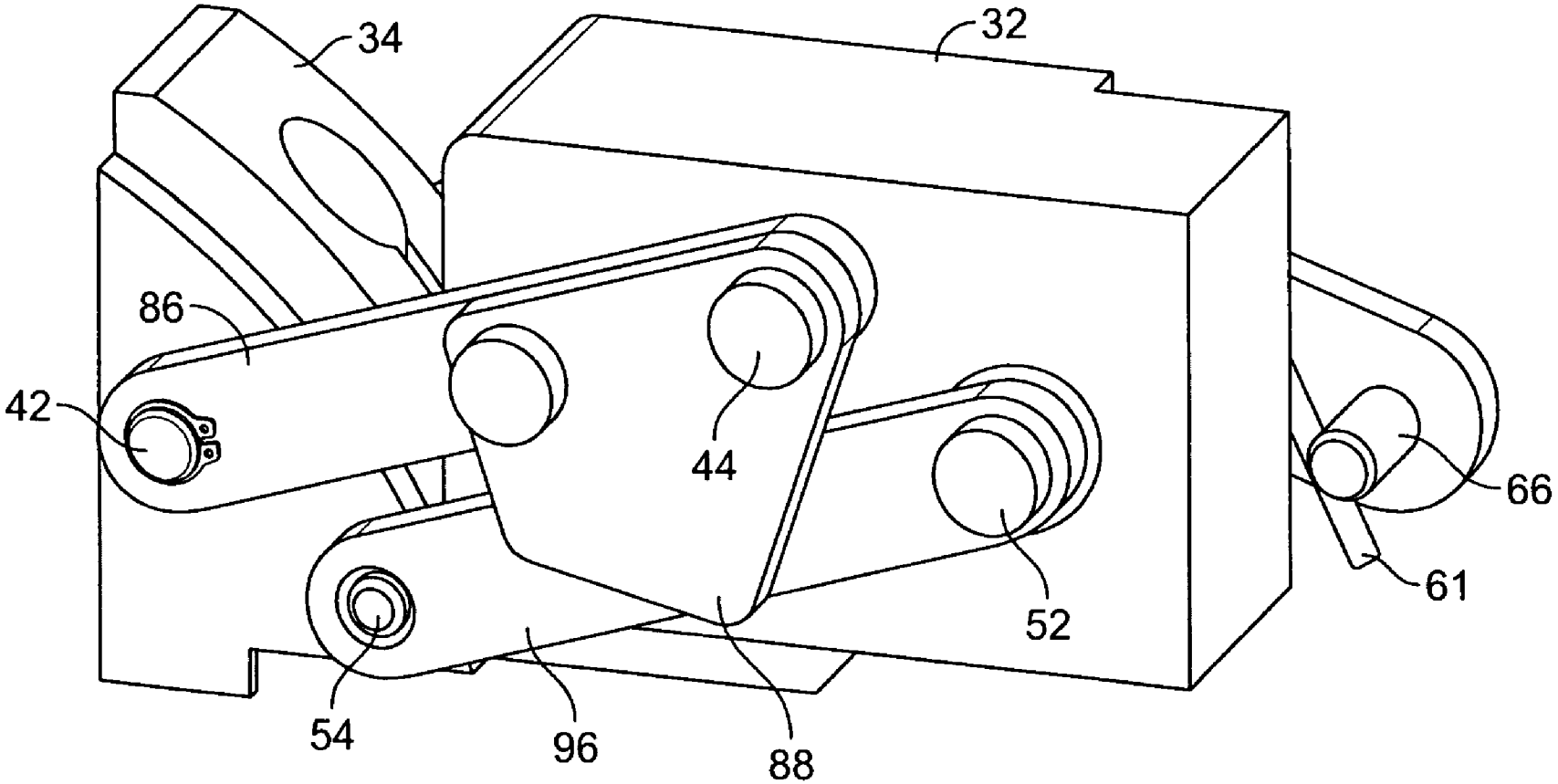
Figure 5:
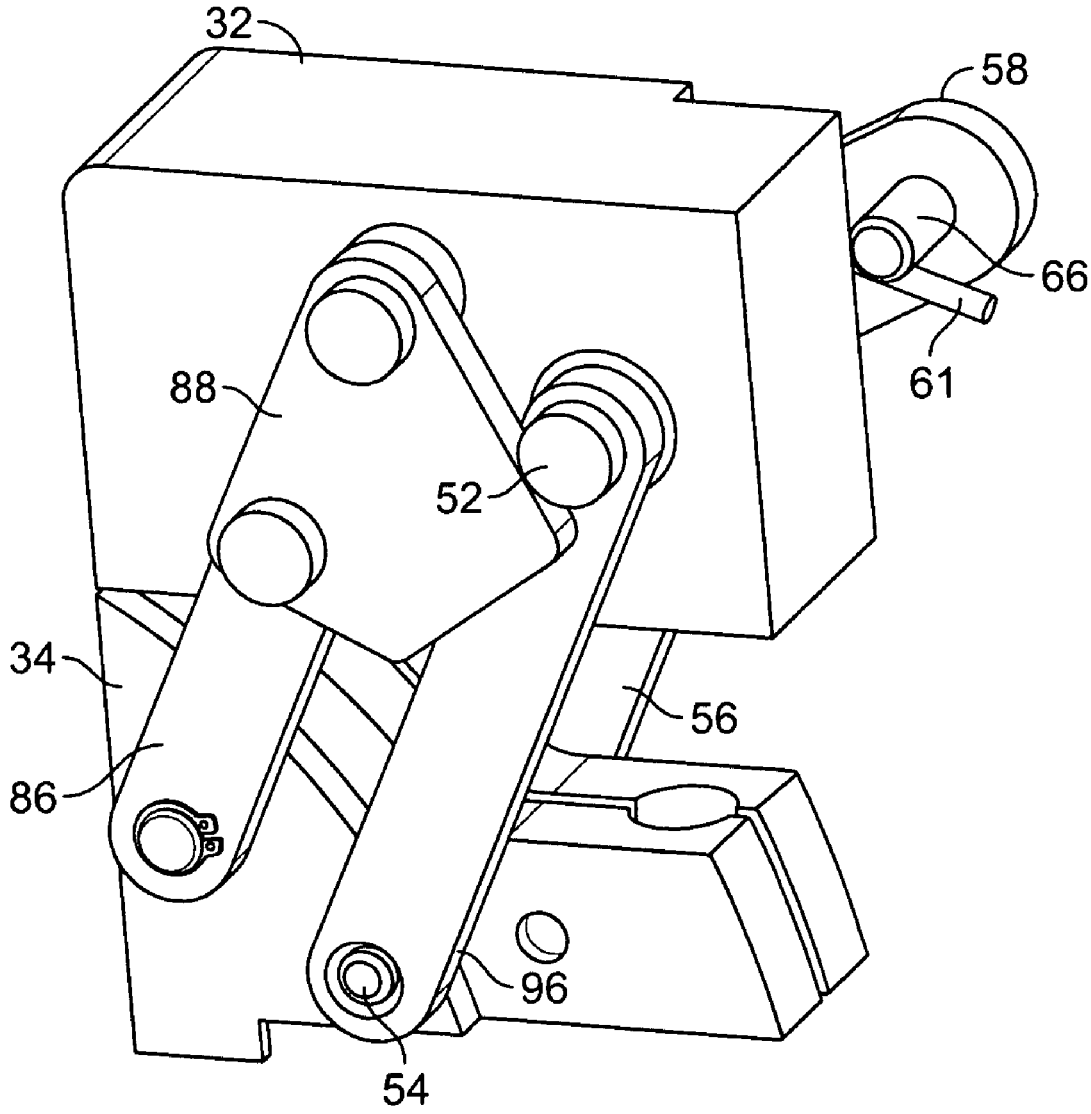
Figure 6:
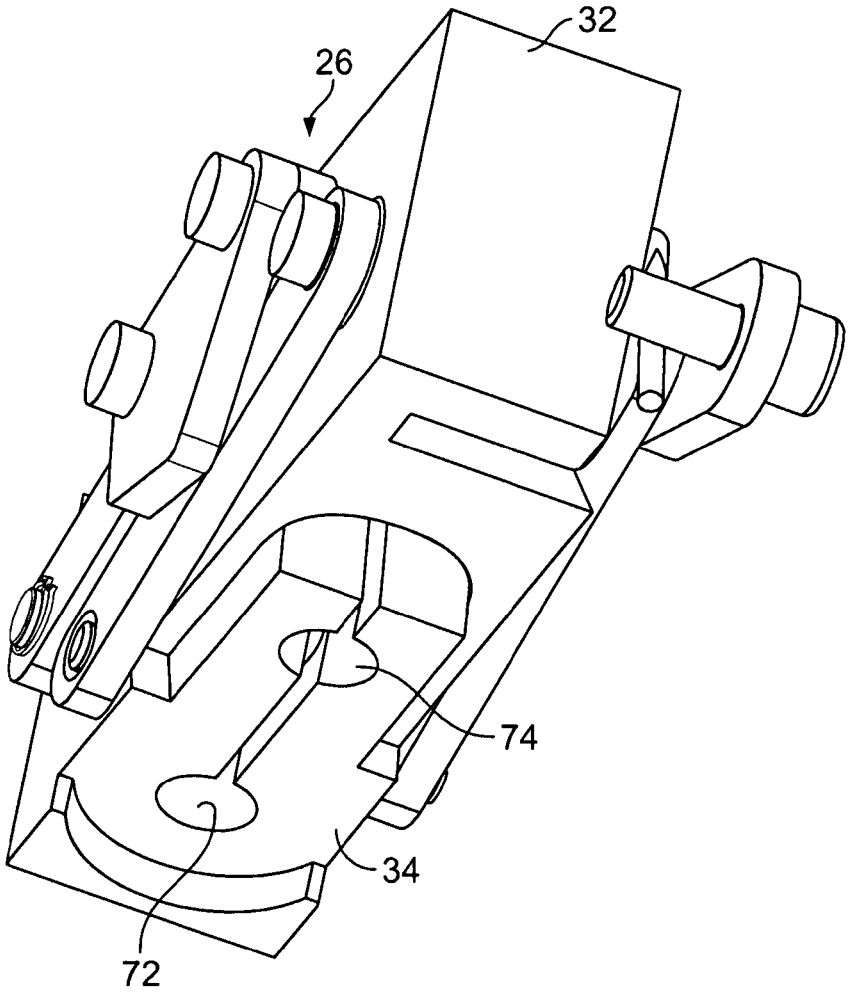

A preferred embodiment of the present invention is described below by reference to the following drawings, in which:

FIG. 2 shows a schematic cross-section view of a rotary gatherer according to the present invention with the pins in the operating position;

FIG. 3 shows a perspective view of a pin according to the present invention in a retracted position;

FIG. 4 shows a perspective view of the pin in a retracted position from the opposite side as shown in FIG. 3;

FIG. 5 shows a perspective view from the same side as in FIG. 4, but with the pin in the operating position;

FIG. 6 shows a perspective view from the bottom of the pin; and

Figure 7:
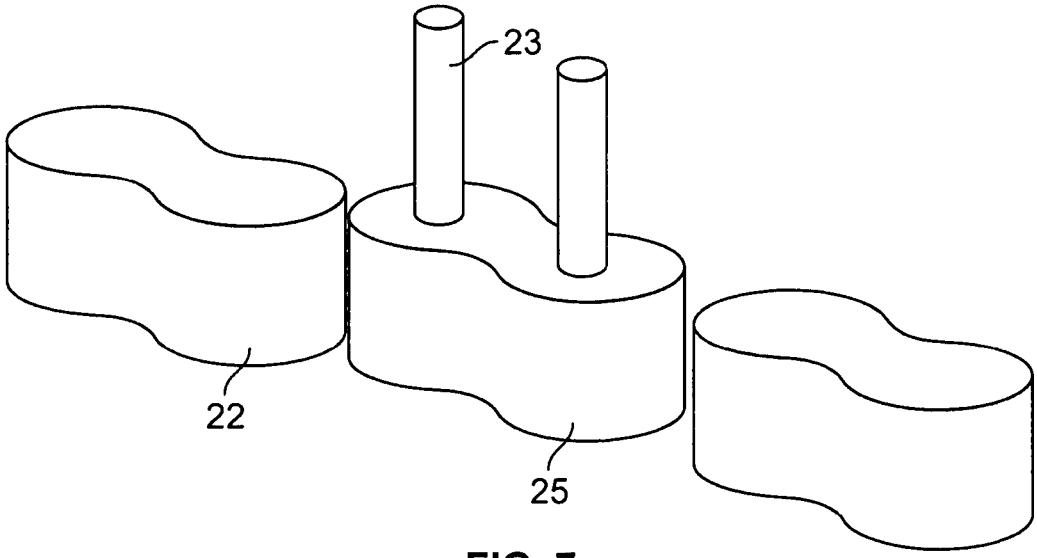

FIG. 7 shows a chain for the pins of the present invention.

DETAILED DESCRIPTION OF A PREFERRED EMBODIMENT

FIG. 2 shows schematically a side view of a rotary gatherer 10 having a drum 12 for delivering printed sheet materials, for example a folded printed product 16 shown released from drum 12 and falling into a pocket area 14 of a conveyor 20.

Conveyor 20 may include a chain 22 and pins 24, 26 which define the pocket area 14. A plurality of drums 12, which may be similar to the drums described in U.S. Pat. No. 3,825,247, for example, are typically provided for the rotary gatherer 10.

The upper surface of chain 22 when underneath the drums 12 may define a receiving surface 28. Each pin 24, 26 may have a first or upper section 32 and a second or lower section 34 fixed to the chain 22, for example via screws or bolts. An arm 36 may connect the first section 32 to the second section 34 to support the first section 32, which is movable with respect to the second section 34. Arm 36 may be pivotally, i.e. rotatably, connected to first and second sections 32, 34.

Arm 36 thus can support the first section 32 in an operating position as shown in FIG. 2 with respect to pin 26, or in a retracted position as shown by the dashed lines in pin 24.

Arm 36 thus is located at an angle A with respect to the surface 28 traveling in a direction D when first section 32 is in the operating position. The operating position angle A may be for example between 60 and 70 degrees, for example 65 degrees. The arms 36 are thus also angled with respect to a front or pushing surface of the first section 32.

Thus when the upper section 32 experiences a horizontal force FH from the front and/or a vertical force FV from the top, first section 32 of a pin 24, 26 can move along a predetermined path P. Objects that thus are located between the drum 12 and the a top surface 28 of first section 32 and exert a primarily vertical force on first section 32 thus cause the first section 32 to move both downwardly and rearwardly in a controlled manner and prevent or reduce damage to the pin or the object.

As described in more detail with respect to FIG. 3, first section 32 may be connected by arm 36 and to second section 34. Arm 36 and a further arm 86 may be connected rotatably to second section 34 via a pin 42, and rotatably connected to first section 32 via a pin 44.

Another arm 56 may be located on the same side of the pin as arm 36 and be connected rotatably to the first section 34 via a pin 54. Arm 56 may be rotatably connected at the other end to first section 32 via a pivot 52. At that end, arm 56 may have an extension 58 having a spring stop 66 attached fixedly thereto.

A torsion spring 60 may fit over pin 52 and into a hole in first section 32, with one moment arm of the torsion spring fitting into a cutaway 62 in first section 32, and the other moment arm 61 of the torsion spring 60 resting against spring stop 66, as shown for example in FIG. 4.

First section 32 thus is spring-loaded in the direction of the operating position to move along path P. First section may have a cutaway 92 interacting with a raised section 94 on the second section to limit sideways motion of the first section 32 and provide more lateral stability. The cutaway 92 and raised section 94 also permit the front 35 of the second section 34 to have an uneven top edge 37 (and the front of the first section to have an uneven bottom edge) so that sheet material does become caught between the first and second sections 32, 34.

Preferably, the first section exerts less than 11 lbs (49 N) of force on an object while moving along path P between the operating and retracted position.

Assuming little friction and a torsion spring, the torsion spring thus may be selected to provide at most 11 lbs of force to a stationary object contacting the top or front of the first section. A spring constant may be chosen to fit this requirement based on dimensions and other characteristics of the rotary gatherer.

As shown in FIGS. 4 and 5, a further arm 96 is provided opposite arm 56, and also connected via pivots 52 and 54. A stop plate 88 fixed to arm 86 prevents, via interaction with pivot 52, the first section 32 from moving past the operating position in a direction opposite the retracted position. Spring 61 may be preloaded during assembly so that some force is present at the operating position to force the pivot 52 of first section 32 against the stop plate 88.

As also shown with respect to FIGS. 5 and 4, as extension 58 moves downwardly from the operating position in FIG. 5 to the retracted position in FIG. 4, spring 60 compresses due to the movement of pin 66 on moment arm 61. Spring 60 thus provides a force to restore the first section 32 to the operating position when a force FV or FH (FIG. 2) is removed from the first section 32.

FIG. 6 shows the underside of second section 34, which has holes 72, 74 for example for permitting to the pin 26 to attach to chain 22, for example by interacting with supports 23 on a master link 25 of the chain 22. The bottom of section 34 can be split as shown and a screw can pull the split sections together to clamp the second section 34 to the supports 23. Master links can be elongated and spaced along chain 22 to provide the proper pocket spacing. The chain 22 can be a side boat chain which spirals 90 degrees to further deliver the collected sheet material.

What is claimed is:

1. A rotary gatherer comprising:

a plurality of drums for delivering printed sheet materials;

a conveyor having a conveyor chain traveling in a horizontal direction;

a first pin and a second pin connected to the conveyor chain and defining a pocket for receiving the printed sheet materials from the drums, the first pin including:

a first section movable horizontally and vertically along a predetermined path with respect to the conveyor chain and a second section fixed to the chain, and a first arm rotatable about the second section, the first section being connected to the second section via the first arm, the first section having an operating position and a retracted position, the first arm being at an angle between 60 and 70 degrees with respect to a traveling receiving surface of the conveyor chain when the first section is in the operating position.

2. The rotary gatherer as recited in claim 1 wherein the angle is 65 degrees.

3. A rotary gatherer comprising:

a plurality of drums for delivering printed sheet materials;

a conveyor having a conveyor chain traveling in a horizontal direction;

a first pin and a second pin connected to the conveyor chain and defining a pocket for receiving the printed sheet materials from the drums, the first pin including:

a first section movable horizontally and vertically along a predetermined path with respect to the conveyor chain and a second section fixed to the chain, a first arm rotatable about the second section, the first section being connected to the second section via the first arm, the first section having an operating position and a retracted position, the first section being spring-loaded in the direction of the operating position, and at least one further arm for supporting the first section, and connecting the first and second sections, the at least one further arm being at an angle less than 90 degrees.

4. A rotary gatherer comprising:

a plurality of drums for delivering printed sheet materials;

a conveyor having a conveyor chain traveling in a horizontal direction;

a first pin and a second pin connected to the conveyor chain and defining a pocket for receiving the printed sheet materials from the drums, the first pin including:

a first section movable horizontally and vertically along a predetermined path with respect to the conveyor chain and a second section fixed to the chain, a first arm rotatable about the second section, the first section being connected to the second section via the first arm, the first section having an operating position and a retracted position, the first section being spring-loaded in the direction of the operating position, and the first section or second section including a cutaway interacting with a raised section on the other of the first and second sections.

5. A rotary gatherer comprising:

a plurality of drums for delivering printed sheet materials;

a conveyor having a conveyor chain traveling in a horizontal direction;

a first pin and a second pin connected to the conveyor chain and defining a pocket for receiving the printed sheet materials from the drums, the first pin including:

a first section movable horizontally and vertically along a predetermined path with respect to the conveyor chain and a second section fixed to the chain, a first arm rotatable about the second section, the first section being connected to the second section via the first arm, the first section having an operating position and a retracted position, and a stop preventing the first section from moving past one end of the predetermined path.

6. A rotary gatherer comprising:

a plurality of drums for delivering printed sheet materials; and a conveyor having a conveyor chain traveling in a horizontal direction and a first pin and a second pin connected to the chain and defining a pocket for receiving the printed sheet materials from the drums, the first pin including a first section movable horizontally and vertically along a predetermined path with respect to the conveyor chain when subjected to a vertical force;

the first pin including a stop preventing the first section from moving past one end of the predetermined path;

wherein the stop includes a stop plate fixed to an arm connecting the first and second sections and interacting with a pivot supporting another arm also connecting the first and second sections.

7. The rotary gatherer as recited in claim 5 wherein the first pin includes at least one further arm for supporting the first section, and connecting the first and second sections, the at least one further arm being at an angle less than 90 degrees.

8. The rotary gatherer as recited in claim 5 wherein the first section or second section includes a cutaway interacting with a raised section on the other of the first and second sections.

9. The rotary gatherer as recited in claim 5 wherein the second pin includes a further section movable horizontally and vertically along a second predetermined path with respect to the conveyor chain.

10. The rotary gatherer as recited in claim 1 wherein the first pin includes at least one further arm for supporting the first section, and connecting the first and second sections, the at least one further arm being at an angle less than 90 degrees.

11. The rotary gatherer as recited in claim 1 wherein the first section or second section includes a cutaway interacting with a raised section on the other of the first and second sections.

12. The rotary gatherer as recited in claim 1 wherein the second pin includes a further section movable horizontally and vertically along a second predetermined path with respect to the conveyor chain.

* * * * *